US008226197B2

(12) United States Patent
Fukui

(10) Patent No.: US 8,226,197 B2
(45) Date of Patent: Jul. 24, 2012

(54) INKJET RECORDING APPARATUS

(75) Inventor: Takashi Fukui, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 301 days.

(21) Appl. No.: 12/647,240

(22) Filed: Dec. 24, 2009

(65) Prior Publication Data

US 2010/0165033 A1 Jul. 1, 2010

(30) Foreign Application Priority Data

Dec. 25, 2008 (JP) ..... 2008-330972

(51) Int. Cl.
*B41J 29/38* (2006.01)

(52) U.S. Cl. ..... 347/16

(58) Field of Classification Search ..... 347/16, 347/104; 271/227, 228
See application file for complete search history.

(56) References Cited

U.S. PATENT DOCUMENTS

2002/0084581 A1 7/2002 Schaum
2009/0295894 A1* 12/2009 Hori ..... 347/102

FOREIGN PATENT DOCUMENTS

JP 11-240217 A 9/1999
JP 2002-292956 A 10/2002

* cited by examiner

*Primary Examiner* — An Do
(74) *Attorney, Agent, or Firm* — Birch, Stewart, Kolasch & Birch, LLP

(57) ABSTRACT

The inkjet recording apparatus includes: an image formation drum which is rotatable in a prescribed rotational direction and includes a front supporting body and a rear supporting body, outer circumferential surfaces of the front and rear supporting bodies constituting a medium supporting surface on which a recording medium is held, the front supporting body having a leading end holding device capable of holding a leading end portion of the recording medium by gripping, the rear supporting body having a trailing end holding device capable of holding a trailing end portion of the recording medium by suction, the front and rear supporting bodies mutually engaging in a circumferential direction of the image formation drum in a state where a length of the medium supporting surface in the circumferential direction is adjustable in accordance with a length of the recording medium in the circumferential direction; an ink ejection device which is disposed at a position opposing an outer circumferential surface of the image formation drum, and which ejects droplets of ink toward the recording medium rotationally conveyed by the image formation drum; and a guide member which is disposed on an upstream side of the ink ejection device in terms of the rotational direction of the image formation drum, and which causes the trailing end portion of the recording medium, the leading end portion of which is gripped by the leading end holding device, to tightly adhere to the outer circumferential surface of the image formation drum.

6 Claims, 8 Drawing Sheets

INKJET RECORDING APPARATUS

BACKGROUND OF THE INVENTION

1. Field of the Invention

The present invention relates to an inkjet recording apparatus, and more particularly to an inkjet recording apparatus which carries out image recording by ejecting and depositing ink onto a recording medium from an inkjet head while rotationally conveying the recording medium which is wrapped about and held on the outer circumferential surface of a drum.

2. Description of the Related Art

In general, an inkjet recording apparatus performs recording by ejecting and depositing droplets of ink onto a recording medium from nozzles arranged on an inkjet head, and the apparatus is able to record images of high resolution and high quality, with little noise during the recording operation and low running costs, and therefore is widely used in a variety of fields.

An inkjet recording apparatus is known which has a cylindrical recording drum and an inkjet head disposed in a position opposing the outer circumferential surface of the recording drum, an image being recorded by ejecting and depositing ink from the inkjet head onto a recording medium while rotationally conveying the recording medium which is wrapped about and held on the outer circumferential surface of the printing drum. In a recording apparatus of this kind, there is a problem in that the recording medium is liable to float up from the outer circumferential surface of the recording drum and deterioration of image quality is liable to occur. Therefore, one important technical issue is to hold and secure the recording medium on the outer circumferential surface of the drum in a tightly adhering state.

Japanese Patent Application Publication No. 11-240217 discloses a drum which is composed in such a manner that, in order to be able to carry out image recording in a stable fashion onto recording media of different lengths, a medium supporting surface formed in a circumferential direction between a leading end gripping device capable of gripping the leading end of a recording medium and a trailing end gripping device capable of gripping the trailing end of same can be extended and contracted in accordance with the length of the recording medium. However, in this drum, although the medium supporting surface can be extended and contracted in accordance with the length of the recording medium, since the trailing end gripping device projects to the outside of the drum, then it is not possible to dispose a guide member in close proximity in a position opposing the outer circumferential surface of the drum, and consequently it is not possible to make the recording medium adhere tightly to the drum. For this reason, if a thick and strong paper is used as the recording medium, then there is a problem in that the recording medium is secured in a state where the recording medium is floating up from the drum.

Japanese Patent Application Publication No. 2002-292956 discloses a drum which has suction apertures formed in the whole of the outer circumferential surface (paper sheet supporting surface) thereof, where a recording medium is held and secured by applying a suction pressure (negative pressure) through the suction apertures. However, in this drum, no consideration whatsoever is given to stably holding recording media of different lengths, and hence there is a problem in that the number of different paper sizes that can be recorded on is small. Furthermore, by simply raising the suction pressure applied to the suction apertures formed on the whole of the outer circumferential surface of the drum, suction leaks occur in the suction apertures located in portions which are not covered by the recording medium, and hence there is a problem in that the trailing end portion of the recording medium cannot be sucked adequately. Consequently, it is difficult to hold and secure thick strong paper in a state of tight adherence to the outer circumferential surface of the drum, without the paper floating up from the drum.

SUMMARY OF THE INVENTION

The present invention has been contrived in view of these circumstances, an object thereof being to provide an inkjet recording apparatus, whereby thick strong paper can be held and secured in a state of tight adherence to the outer circumferential surface of a drum, without floating up from the drum.

In order to attain the aforementioned object, the present invention is directed to an inkjet recording apparatus, comprising: an image formation drum which is rotatable in a prescribed rotational direction and includes a front supporting body and a rear supporting body, outer circumferential surfaces of the front and rear supporting bodies constituting a medium supporting surface on which a recording medium is held, the front supporting body having a leading end holding device capable of holding a leading end portion of the recording medium by gripping, the rear supporting body having a trailing end holding device capable of holding a trailing end portion of the recording medium by suction, the front and rear supporting bodies mutually engaging in a circumferential direction of the image formation drum in a state where a length of the medium supporting surface in the circumferential direction is adjustable in accordance with a length of the recording medium in the circumferential direction; an ink ejection device which is disposed at a position opposing an outer circumferential surface of the image formation drum, and which ejects droplets of ink toward the recording medium rotationally conveyed by the image formation drum; and a guide member which is disposed on an upstream side of the ink ejection device in terms of the rotational direction of the image formation drum, and which causes the trailing end portion of the recording medium, the leading end portion of which is gripped by the leading end holding device, to tightly adhere to the outer circumferential surface of the image formation drum.

According to this aspect of the present invention, in the image formation drum composed in such a manner that the medium supporting surface can be extended and contracted in accordance with the length of the recording medium, by providing the leading end holding device capable of gripping the leading end portion of the recording medium and the trailing end holding device capable of holding the trailing end portion of the recording medium by suction, it is possible to prevent interference with the guide member, even if the guide member is disposed in close proximity in the position opposing the outer circumferential surface of the image formation drum. Consequently, it is possible to hold and secure thick strong paper in a state of tight adherence to the outer circumferential surface of the image formation drum, without the paper floating up above the drum. As a result of this, it is possible to improve image quality.

Preferably, the guide member is arranged separately from the outer circumferential surface of the image formation drum.

According to this aspect of the present invention, since the guide member is disposed at a prescribed gap (and more desirably a gap equal to the thickness of the recording medium) away from the outer circumferential surface of the image formation drum, it is possible to hold and secure the recording medium on the outer circumferential surface of the image formation drum without creating projections-recessions in the recording medium.

Preferably, the guide member includes a roller member which is rotatable in a prescribed direction.

According to this aspect of the present invention, there is little frictional resistance to the recording medium, and it is possible to cause the recording medium to tightly adhere in a stable fashion on the outer circumferential surface of the image formation drum.

Preferably, the inkjet recording apparatus further comprises a roller movement device which moves the roller member along a radial direction of the image formation drum in accordance with a thickness of the recording medium.

According to this aspect of the present invention, it is possible to make recording media of different thicknesses adhere tightly to the outer circumferential surface of the image formation drum without creating projections-recessions in the recording media.

Preferably, the rear supporting body includes a plurality of suction devices arranged in an axial direction of the image formation drum; and the inkjet recording apparatus further comprises a first control device which selectively controls on/off switching of suction by the respective suction devices in accordance with a width of the recording medium.

According to this aspect of the present invention, since it is possible to alter the suction range in accordance with the width of the recording medium (the dimension of the recording medium in the axial direction of the image formation drum), then the suction force on the recording medium can be raised, while preventing wasteful suction. By this means, it is possible to hold and secure thicker paper on the outer circumferential surface of the image formation drum.

Preferably, the inkjet recording apparatus further comprises a second control device which controls a timing of on/off switching of suction by the respective suction devices in accordance with a position of the trailing end portion of the recording medium.

According to this aspect of the present invention, it is possible to raise the suction force when securing the trailing end portion of the recording medium, and thicker paper can be held and secured on the outer circumferential surface of the image formation drum.

According to the present invention, in an image formation drum composed in such a manner that a medium supporting surface can be extended and contracted in accordance with the length of a recording medium, by providing a leading end holding device capable of gripping the leading end portion of the recording medium and a trailing end holding device capable of holding the trailing end portion of the recording medium by suction, it is possible to prevent interference with a guide member, even if the guide member is disposed in close proximity in the position opposing the outer circumferential surface of the image formation drum. Consequently, it is possible to hold and secure thick strong paper in a state of tight adherence to the outer circumferential surface of the image formation drum, without the paper floating up above the drum. As a result of this, it is possible to improve image quality.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Entire Configuration of Inkjet Recording Apparatus

First, an inkjet recording apparatus will be described as an embodiment of an image forming apparatus according to the present invention.

Figure 1:
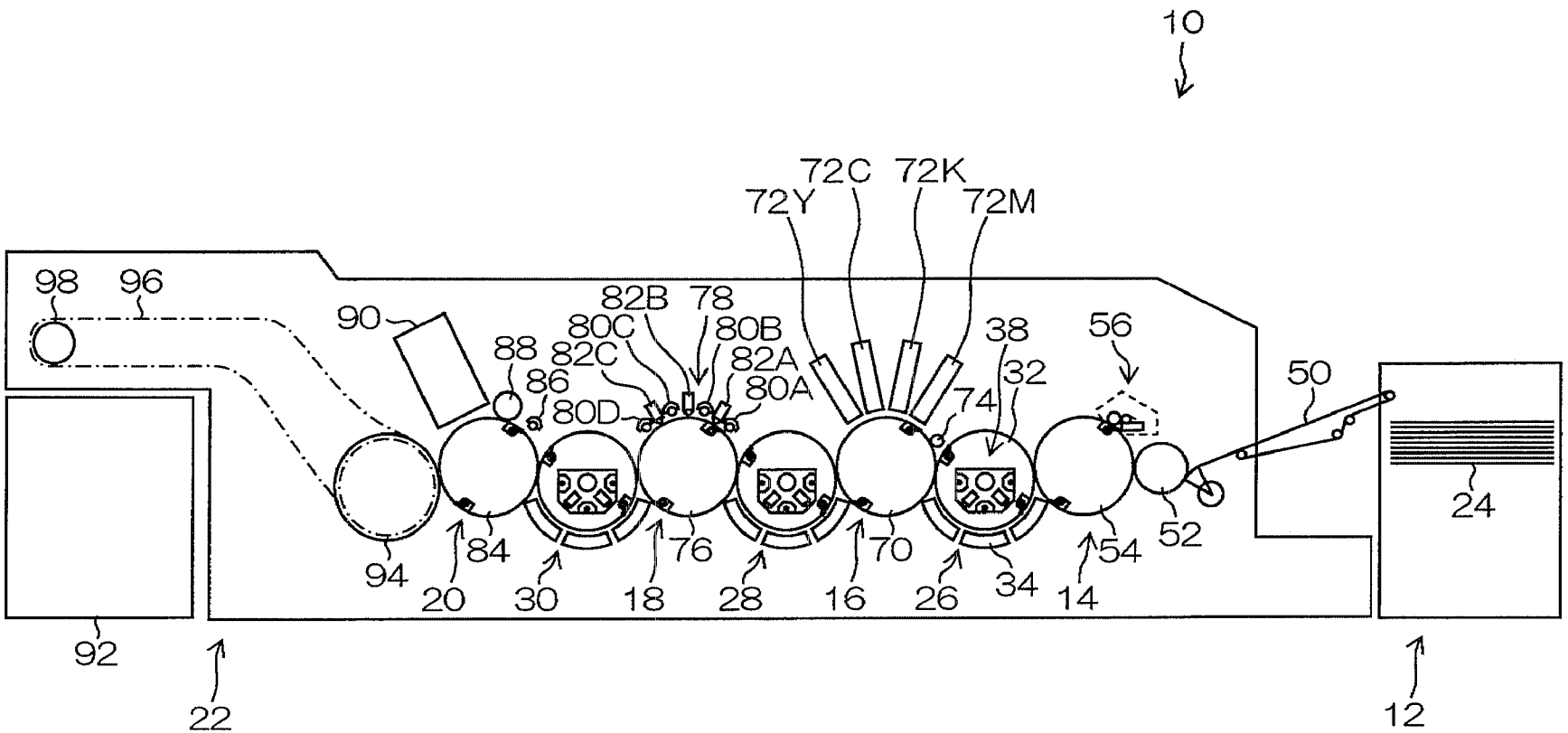
FIG. 1 is a schematic structural diagram illustrating an inkjet recording apparatus according to an embodiment of the present invention.

FIG. 1 is a structural diagram illustrating the entire configuration of an inkjet recording apparatus 10 according to an embodiment of the present invention. The inkjet recording apparatus 10 shown in the drawing is an recording apparatus in a two-liquid aggregating system of forming an image on a recording surface of a recording medium 24 by using ink and a treatment liquid (aggregation treatment liquid). The inkjet recording apparatus 10 includes a paper feed unit 12, a treatment liquid application unit 14, an image formation unit 16, a drying unit 18, a fixing unit 20, and a discharge unit 22 as the main components. A recording medium 24 (paper sheets) is stacked in the paper feed unit 12, and the recording medium 24 is fed from the paper feed unit 12 to the treatment liquid application unit 14. A treatment liquid is applied to the recording surface in the treatment liquid application unit 14, and then a color ink is applied to the recording surface in the image formation unit 16. The image is fixed with the fixing unit 20 on the recording medium 24 onto which the ink has been applied, and then the recording medium is discharged with the discharge unit 22.

In the inkjet recording apparatus 10, intermediate conveyance units 26, 28 and 30 are provided between the units, and the recording medium 24 is transferred by these intermediate conveyance units 26, 28 and 30. Thus, a first intermediate conveyance unit 26 is provided between the treatment liquid application unit 14 and image formation unit 16, and the recording medium 24 is transferred from the treatment liquid application unit 14 to the image formation unit 16 by the first intermediate conveyance unit 26. Likewise, the second intermediate conveyance unit 28 is provided between the image formation unit 16 and the drying unit 18, and the recording medium 24 is transferred from the image formation unit 16 to the drying unit 18 by the second intermediate conveyance unit 28. Further, a third intermediate conveyance unit 30 is provided between the drying unit 18 and the fixing unit 20, and the recording medium 24 is transferred from the drying unit 18 to the fixing unit 20 by the third intermediate conveyance unit 30.

Each unit (paper feed unit 12, treatment liquid application unit 14, image formation unit 16, drying unit 18, fixing unit 20, discharge unit 22, and first to third intermediate conveyance units 26, 28 and 30) of the inkjet recording apparatus 10 will be described below in greater details.

<Paper Feed Unit>

The paper feed unit 12 feeds the recording medium 24 to the image formation unit 16. A paper feed tray 50 is provided in the paper feed unit 12, and the recording medium 24 is fed, sheet by sheet, from the paper feed tray 50 to the treatment liquid application unit 14.

<Treatment Liquid Application Unit>

The treatment liquid application unit 14 is a mechanism that applies a treatment liquid to the recording surface of the recording medium 24. The treatment liquid includes a coloring material aggregating agent that causes the aggregation of a coloring material (pigment) included in the ink applied in the image formation unit 16, and the separation of the coloring material and a solvent in the ink is enhanced when the treatment liquid is brought into contact with the ink.

As shown in FIG. 1, the treatment liquid application unit 14 includes a paper transfer drum 52, a treatment liquid drum 54, and a treatment liquid application device 56. The paper transfer drum 52 is disposed between the paper feed tray 50 of the paper feed unit 12 and the treatment liquid drum 54. The rotation of the paper transfer drum 52 is driven and controlled by a below-described motor driver 176 (see FIG. 8). The recording medium 24 fed from the paper feed unit 12 is received by the paper transfer drum 52 and transferred to the treatment liquid drum 54. The below-described intermediate conveyance unit may be also provided instead of the paper transfer drum 52.

The treatment liquid drum 54 is a drum that holds and rotationally conveys the recording medium 24. The rotation of the treatment liquid drum 54 is driven and controlled by the below-described motor driver 176 (see FIG. 8). Further, the treatment liquid drum 54 is provided on the outer circumferential surface thereof with a hook-shaped holding device (device identical to a below-described gripper 102 shown in FIG. 2). The leading end of the recording medium 24 is held by the holding device. In a state in which the leading end of the recording medium 24 is held by the holding device, the treatment liquid drum 54 is rotated to rotationally convey the recording medium 24. In this case, the recording medium 24 is conveyed in a state where the recording surface thereof faces outward. The treatment liquid drum 54 may be provided with suction apertures on the outer circumferential surface thereof and connected to a suction device that performs suction from the suction apertures. As a result, the recording medium 24 can be held in a state of tight adherence to the outer circumferential surface of the treatment liquid drum 54.

The treatment liquid application device 56 is provided on the outside of the treatment liquid drum 54 opposite the outer circumferential surface thereof. The treatment liquid application device 56 applies the treatment liquid onto the recording surface of the recording medium 24. The treatment liquid application device 56 includes: a treatment liquid container, in which the treatment liquid to be applied is held; an anilox roller, a part of which is immersed in the treatment liquid held in the treatment liquid container; and a rubber roller, which is pressed against the anilox roller and the recording medium 24 that is held by the treatment liquid drum 54, so as to transfer the treatment liquid metered by the anilox roller 64 to the recording medium 24.

With the treatment liquid application device 56 of the above-described configuration, the treatment liquid is applied onto the recording medium 24, while being metered. In this case, it is preferred that the film thickness of the treatment liquid be sufficiently smaller than the diameter of ink droplets that are ejected from inkjet heads 72M, 72K, 72C and 72Y of the image formation unit 16. For example, when the ink droplet volume is 2 picoliters (pl), the average diameter of the droplet is 15.6 μm. In this case, when the film thickness of the treatment liquid is large, the ink dot will be suspended in the treatment liquid, without coming into contact with the surface of the recording medium 24. Accordingly, when the ink droplet volume is 2 pl, it is preferred that the film thickness of the treatment liquid be not more than 3 μm in order to obtain a landing dot diameter not less than 30 μm.

In the present embodiment, the application system using the roller is used to deposit the treatment liquid onto the recording surface of the recording medium 24; however, the present invention is not limited to this, and it is possible to employ a spraying method, an inkjet method, or other methods of various types.

<Image Formation Unit>

Figure 2:
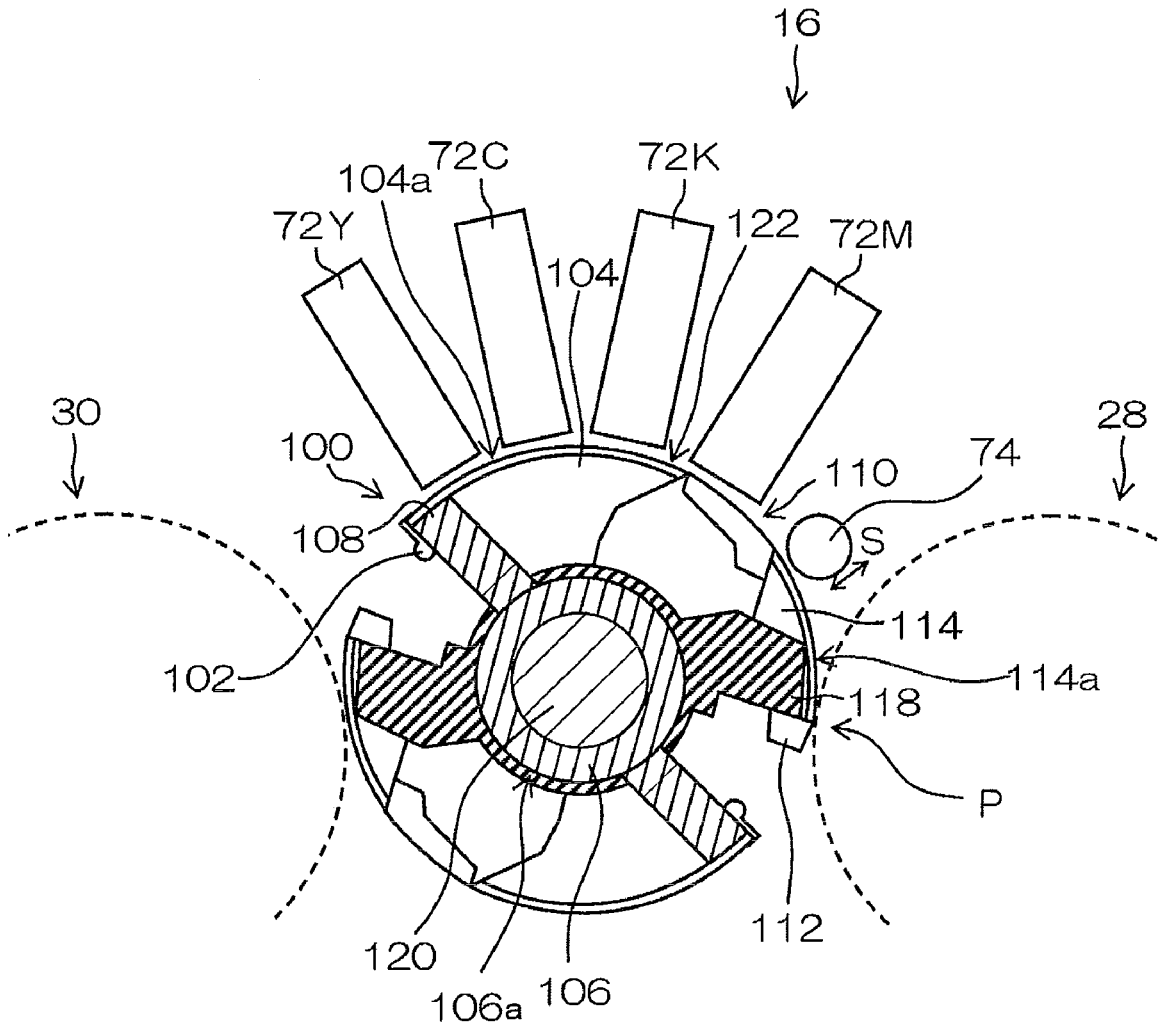
FIG. 2 is a structural diagram illustrating an image formation unit in the inkjet recording apparatus in FIG. 1.
Figure 3:
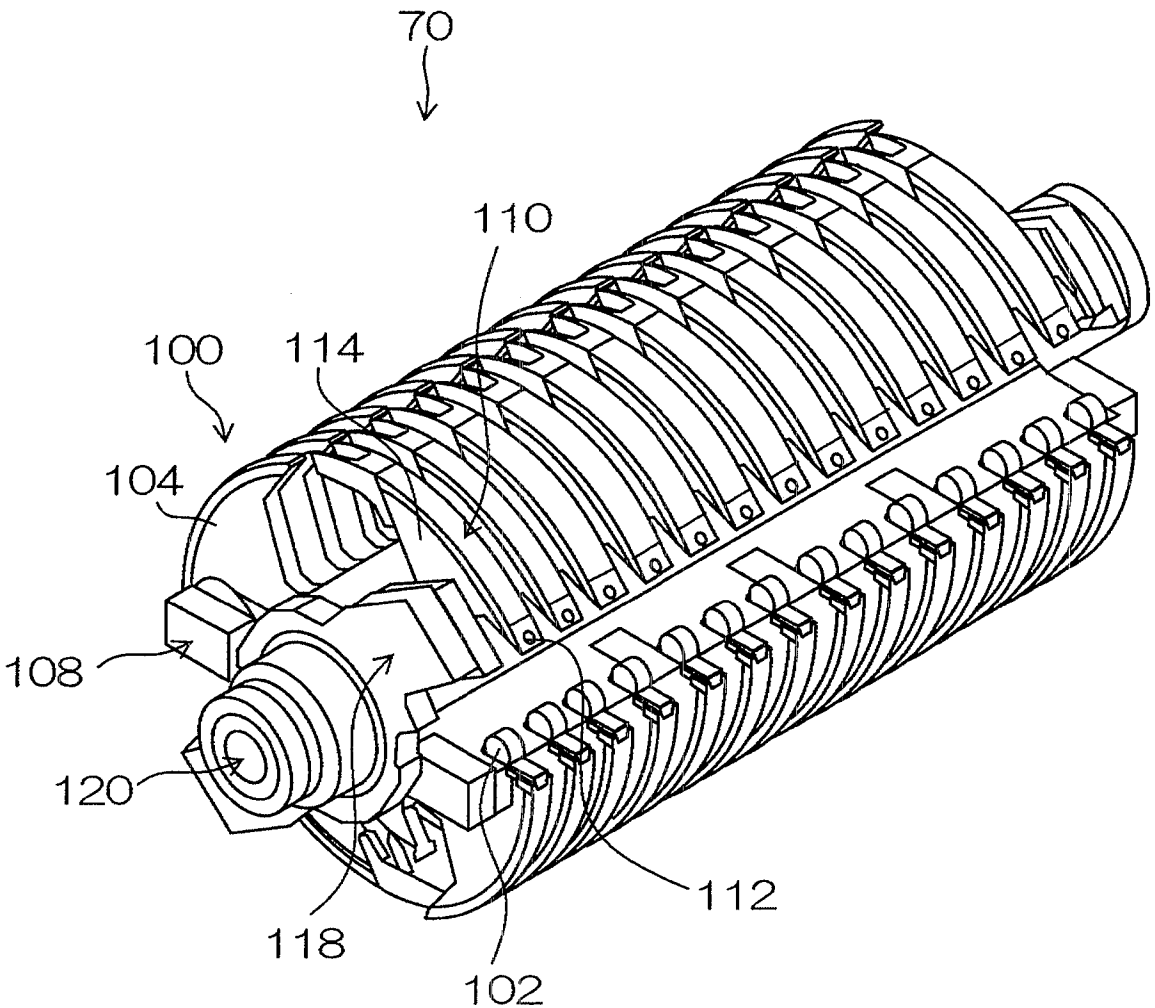
FIG. 3 is a perspective diagram showing an image formation drum which is disposed in a print unit.
Figure 4:
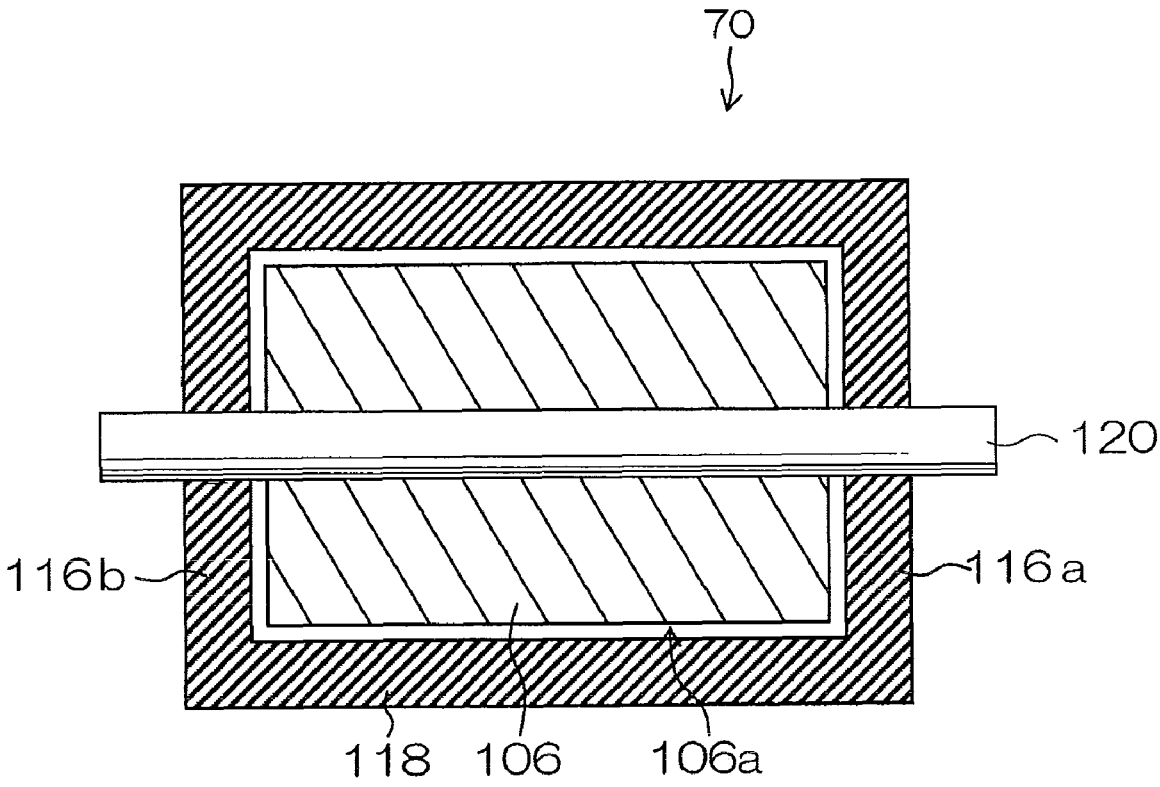
FIG. 4 is a cross-sectional diagram parallel to the axial direction of the image formation drum.
Figure 5A:
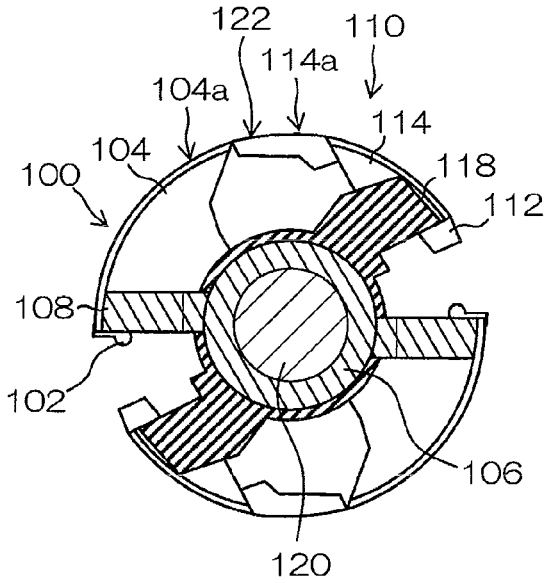
FIGS. 5A to 5C are illustrative diagrams showing a state of changing length of the paper supporting surface of the image formation drum.
Figure 5B:
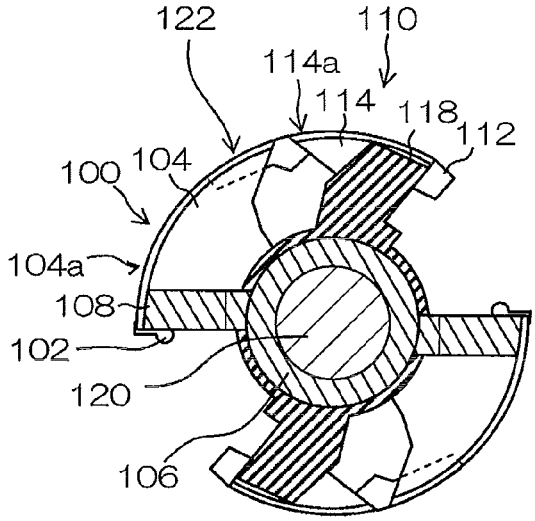
Figure 5C:
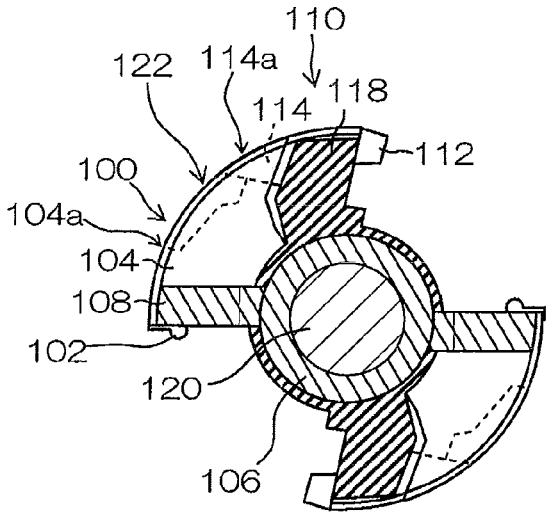

FIG. 2 shows the configuration of the image formation unit 16 of the inkjet recording apparatus 10 in FIG. 1. FIG. 3 is a perspective diagram showing an image formation drum 70 disposed in the image formation unit 16, and FIG. 4 is a cross-sectional diagram parallel to the axis direction of the image formation drum 70. Moreover, FIGS. 5A to 5C are illustrative diagrams showing states where the length of a paper supporting surface of the image formation drum 70 changes.

The image formation unit 16 is a mechanism which prints an image corresponding to an input image by ejecting and depositing droplets of ink by an inkjet method, and the image formation unit 16 includes the image formation drum 70, a paper pressing roller 74 and inkjet heads 72M, 72K, 72C and 72Y. The inkjet heads 72M, 72K, 72C and 72Y correspond to inks of four colors: magenta (M), black (K), cyan (C) and yellow (Y), and are disposed in the order of description from the upstream side in the rotation direction of the image formation drum 70.

The image formation drum 70 is a drum that holds the recording medium 24 on the outer circumferential surface thereof and rotationally conveys the recording medium 24. The rotation of the image formation drum 70 is driven and controlled by the below-described motor driver 176 (see FIG. 8).

The image formation drum 70 has a front supporting body 100 and a rear supporting body 110. The front supporting body 100 includes grippers 102, which grip the leading end portion of the recording medium 24. The rear supporting body 110 includes suction units 112, which suck and hold the trailing end portion of the recording medium 24. The front supporting body 100 and the rear supporting body 110 are mutually engaged in the front/rear direction, in such a manner that the distance of separation between the grippers 102 and the suction units 112 in the circumferential direction of the image formation drum 70 can be changed in accordance with the length of the recording medium 24. The recording medium 24 is rotationally conveyed by the rotation of the image formation drum 70 in a state where the leading end portion is gripped between the grippers 102 and the outer circumferential surface of the image formation drum 70, and the trailing end portion is sucked and held by the suction unit 112. In this, the recording medium 24 is conveyed in a state where the recording surface thereof faces outward, and inks are deposited on the recording surface by the inkjet heads 72M, 72K, 72C and 72Y.

Furthermore, as shown in FIG. 2, the paper pressing roller 74 is provided to the outside of the image formation drum 70 so as to face the outer circumferential surface of the image formation drum 70. The paper pressing roller 74 is a guide member for causing the recording medium 24 to tightly adhere to the outer circumferential surface of the image formation drum 70. The paper pressing roller 74 is disposed to the downstream side of the position where transfer of the recording medium 24 is received (the position indicated by symbol P in FIG. 2), and to the upstream side from the inkjet heads 72M, 72K, 72C and 72Y, in terms of the direction of conveyance of the recording medium 24 (the direction of rotation of the image formation drum 70). Desirably, the paper pressing roller 74 is disposed in the vicinity of the receiving position P, to the downstream side in terms of the direction of conveyance.

When the recording medium 24 that has been transferred onto the image formation drum 70 from the intermediate conveyance unit 26 is rotationally conveyed in a state where the leading end portion of the recording medium 24 is gripped by the grippers 102, it is possible to make the recording medium 24 adhere tightly to the outer circumferential surface of the image formation drum 70 by pressing the recording medium 24 (and in particular the trailing end portion thereof) against the outer circumferential surface of the image formation drum 70, while causing the paper pressing roller 74 to rotate. When the recording medium 24 has been made to tightly adhere to the outer circumferential surface of the image formation drum 70 in this way, the trailing end portion of the recording medium 24 is sucked and held on the outer circumferential surface of the image formation drum 70 by vacuum suction by the suction units 112, and the recording medium 24 is conveyed to a print region directly below the inkjet heads 72M, 72K, 72C and 72Y in a state where the recording medium 24 does not float up at all from the outer circumferential surface of the image formation drum 70.

Desirably, the paper pressing roller 74 is disposed at a distance of separation from the outer circumferential surface of the image formation drum 70, so as to form a uniform gap (and desirably a gap corresponding to the thickness of the recording medium 24) from the outer circumferential surface of the image formation drum 70. Thereby, the paper pressing roller 74 can cause the recording medium 24 to tightly adhere to the outer circumferential surface of the image formation drum 70 without creating projections-recessions therein.

Furthermore, it is also possible to provide a roller movement mechanism (not shown) which is capable of advancing and retracting the paper pressing roller 74 following the radial direction of the image formation drum 70 (the direction indicated by arrow S in FIG. 2), in such a manner that the size of the gap formed between the paper pressing roller 74 and the outer circumferential surface of the image formation drum 70 can be changed in accordance with the thickness of the recording medium 24. The thickness of the recording medium 24 may be input manually by a user before starting printing, or alternatively the thickness of the recording medium 24 may be input automatically by providing a sensor (recording medium determination sensor) which determines the thickness of the recording medium 24. In this case, it is possible to make the recording media 24 of different thicknesses adhere tightly to the outer circumferential surface of the image formation drum 70 without creating projections-recessions in the recording medium 24.

In the present embodiment, the guide member for making the recording medium 24 tightly adhere is constituted of the paper pressing roller 74; however, the guide member is not limited to this and, for example, it is also possible to fix a guide member having a guide surface, such as a planar or arc-shape surface, so as to form a prescribed gap with respect to the outer circumferential surface of the image formation drum 70, in such a manner that the recording medium 24 is passed through this gap.

Here, the structure of the image formation drum 70 will be described in detail.

As shown in FIGS. 2 to 5C, the front supporting body 100 and the rear supporting body 110, which constitute the image formation drum 70, respectively have paper supporting leaf sections 104 and 114, which are mutually engaged. The respective paper supporting leaf sections 104 and 114 are arranged at uniform intervals in the axial direction of the image formation drum 70. The front supporting body 100 has the grippers 102 provided on the front end faces of the paper supporting leaf sections 104, and the rear supporting body 110 has the suction units 112 provided on the rear end faces of the paper supporting leaf sections 114. The paper supporting leaf sections 104 and 114 of the front and rear supporting bodies 100 and 110 thus engage with each other in a comb-like configuration, and thereby constitute a paper supporting surface 122 of a prescribed angular region which is continuous in the circumferential direction between the grippers 102 and the suction units 112, from the arc-shaped outer surfaces of the paper supporting leaf sections 104 and 114. The image formation drum 70 according to the present embodiment is a so-called double circumference drum, which has respective paper supporting surfaces 122 for supporting the recording media 24 at two opposite positions which are 180° apart on the outer circumferential surface. For this reason, the grippers 102 and the suction units 112 are respectively provided on the two paper supporting surfaces 122.

The front supporting body 100 is fixed in a non-rotatable fashion with respect to a drum axle 120, whereas the rear supporting body 110 is rotatable with respect to the drum axle 120 and can be secured at a desired position, so that the rear supporting body 110 can be rotated relatively with respect to the front supporting body 100.

As the length of engagement of the paper supporting leaf sections 104 and 114 is made gradually shorter by rotating the rear supporting body 110 relatively backward from the front supporting body 100, the paper supporting surface 122 correspondingly becomes longer. The length of the paper supporting surface 122 in the circumferential direction becomes a maximum in a state immediately before the rear end of the paper supporting leaf section 104 of the front supporting body 100 and the front end of the paper supporting leaf section 114 of the rear supporting body 110 separate from each other (see FIG. 5A). Conversely, when the rear supporting body 110 is rotated relatively forward to the front supporting body 100 so as to gradually increase the length of engagement of the paper supporting leaf sections 104 and 114, then the paper supporting surface 122 accordingly contracts. The length of the paper supporting surface 122 in the circumferential direction becomes a minimum in a state where the paper supporting leaf section 104 of the front supporting body 100 and the paper supporting leaf section 114 of the rear supporting body 110 are almost completely overlapping (see FIG. 5C).

Moreover, to give a detailed explanation of the structure of the image formation drum 70, as shown in FIGS. 2 to 5C, the front supporting body 100 has a cylinder section 106 and a pair of axle linking sections 108. The cylinder section 106 is fitted externally over the drum axle 120, and is composed so as to be non-rotatable with respect to the drum axle 120. Each of the axle linking sections 108 projects in the outward radial direction from the outer circumferential surface 106*a* of the cylinder section 106, and is formed substantially in parallel with the drum axle 120. The axle linking sections 108 are arranged in opposing positions approximately 180° apart with respect to each other, and are formed an in integrated fashion with the cylinder section 106.

The paper supporting leaf sections 104 are arranged at uniform intervals apart in the axial direction, on the axle linking sections 108 of the front supporting body 100. Furthermore, the paper supporting leaf sections 104 are linked and united by means of the axle linking sections 108, which are substantially parallel to the drum axle 120, rather than by the drum axle 120 itself.

As shown in FIGS. 2 to 5C, the paper supporting leaf sections 104 of the front supporting body 100 are arranged in the form of comb teeth facing toward the rear side in the circumferential direction, with the gripping positions of the grippers 102 forming base end sections. Furthermore, the paper supporting leaf sections 104 have arc-shaped outer surfaces 104*a* of a prescribed angle centered on the drum axle 120, and these outer surfaces 104*a* constitute the paper supporting surface 122, which supports the recording medium 24.

As shown in FIGS. 2 to 5C, the rear supporting body 110 has a pair of bearing sections 116*a* and 116*b* and a pair of axle linking sections 118. The bearing sections 116*a* and 116*b* are rotatably fitted externally on the drum axle 120, on either side in the axial direction of the cylinder section 106 constituting the front supporting body 100. Each of the axle linking sections 118 links the bearing sections 116*a* and 116*b* on the outer circumference portion thereof, in a substantially parallel direction to the drum axle 120. The axle linking sections 118 are arranged in opposite positions approximately 180° apart with respect to each other, as shown in FIG. 2. Furthermore, as shown in FIG. 4, the axle linking sections 118 are arranged at a prescribed interval away from the outer circumferential surface 106*a* of the cylinder section 106, and are disposed between the two axle linking sections 108 of the front supporting body 100 in the circumferential direction, being movable between same relatively in the front/rear circumferential direction.

Similarly to the front supporting body 100, the paper supporting leaf sections 114 are arranged at uniform intervals apart in the axial direction on the axle linking sections 118 of the rear supporting body 110. The paper supporting leaf sections 114 are disposed in a mutually engaging relationship with the paper supporting leaf sections 104 of the front supporting body 100. Moreover, the paper supporting leaf sections 114 are linked and united by means of the axle linking sections 118, which are substantially parallel to the drum axle 120, rather than by the drum axle 120 itself.

The paper supporting leaf sections 114 of the rear supporting body 110 are disposed in the form of comb teeth facing towards the front side conversely to the front supporting body 100, with the suction apparatus 112 forming a base end section. Furthermore, as shown in FIG. 2, the paper supporting leaf sections 114 have arc-shaped outer surfaces 114*a* of a prescribed angle centered on the drum axle 120, and these outer surfaces 114*a* constitute the paper supporting surface 122, which supports the recording medium 24.

In this way, the image formation drum 70 is constituted in such a manner that the front supporting body 100 is non-rotatable with respect to the drum axle 120, the rear supporting body 110 is rotatable with respect to the drum axle 120, and the rear supporting body 110 can be rotated relatively with respect to the front supporting body 100. By rotating the rear supporting body 110 relatively with respect to the front supporting body 100 and thereby adjusting the length of engagement of the paper supporting leaf sections 104 and 114, a composition is achieved in which the length of the paper supporting surface 122 in the circumferential direction can be adjusted.

Moreover, the grippers 102 are disposed at prescribed intervals in the axial direction of the image formation drum 70 (more specifically, at positions corresponding respectively to the paper supporting leaf sections 104) in the front end of the front supporting body 100, and the leading end portion of the recording medium 24 is gripped by the respective grippers 102. A gripper opening and closing mechanism (not shown) for opening and closing the grippers 102 is provided in the image formation drum 70.

Furthermore, the suction units 112 are disposed at prescribed intervals in the axial direction of the image formation drum 70 (more specifically, at positions corresponding respectively to the paper supporting leaf sections 114) in the rear end of the rear supporting body 110. Suction holes (not shown) are formed on the outer circumferential surfaces of the suction units 112, and the suction holes are connected through vacuum flow channels to a vacuum pump 194 (shown in FIG. 8), which is external to the image formation drum 70. By operating the vacuum pump 194, a negative pressure (vacuum pressure) is generated in the suction holes of the suction units 112 and the trailing end portion of the recording medium 24 is thereby held by suction.

Moreover, the image formation drum 70 is provided with a switching device (not shown), which sets the supporting body (in the present embodiment, the rear supporting body 110) that is rotatable with respect to the drum axle 120 to a non-rotatable state (secured state) with respect to the drum axle 120 during printing, and sets this supporting body to a rotatable state with respect to the drum axle 120 when changing the paper size.

According to the thus composed image formation drum 70, during a printing operation, the rear supporting body 110 is secured so as not to rotate with respect to the drum axle 120 and is therefore able to rotate unitedly with the drum axle 120 together with the front supporting body 100. When adjusting the length of the paper supporting surface 122 in accordance with change in the length of the recording medium 24 (in other words, when changing the paper size), the rear supporting body 110 is set to be rotatable with respect to the drum axle 120, the rear supporting body 110 is rotated to the prescribed position, and while maintaining this state of the rear supporting body 110, the drum axle 120 is rotated so as to turn the front supporting body 100 united with the drum axle 120, in the front/rear direction, together with the drum axle 120.

Furthermore, a desirable mode is one in which a composition is adopted where it is possible selectively to control the on and off switching of suction by the respective suction units 112 provided in the axial direction of the image formation drum 70, in accordance with the width of the recording medium 24 (the dimension of the recording medium 24 in the axial direction of the image formation drum 70). According to this mode, it is possible to vary the suction range in accordance with the width of the recording medium 24, and therefore it is possible to increase the suction force applied to the recording medium 24 while preventing wasteful suction. By this means, it is possible to hold and secure thicker paper on the outer circumferential surface of the image formation drum 70.

Furthermore, it is also possible to control the timing of the on/off switching of suction by the suction units 112 in accordance with the trailing end position of the recording medium 24. More specifically, in switching the on and off of the suction, rather than switching the vacuum pump 194 on and off, a valve is provided at an intermediate position on the vacuum flow channel and the valve is turned on (opened) or off (closed). By this means, the flow channel from the valve to the vacuum pump is vacuum suctioned at low pressure while the valve is off and the suction force of the suction units 112 can be raised immediately that the valve is turned on. Consequently, it is possible to raise the suction force when securing the trailing end portion of the recording medium 24, and thicker paper can be held and secured on the outer circumferential surface of the image formation drum 70.

In the present embodiment, the front supporting body 100 is made non-rotatable about the drum axle 120, but it is also possible to make the rear supporting body 110 non-rotatable. Apart from this, the paper supporting leaf sections 104 and 114 are not limited to a plate shape, and may also adopt various other shapes. Furthermore, it is also possible to provide auxiliary supporting leaf sections which support the recording medium 24 by bridging between the respective ends of the paper supporting leaf sections 104 of the front supporting body 100 and the paper supporting leaf sections 114 of the rear supporting body 110, when these end portions are separated from each other in the circumferential direction.

The inkjet heads 72M, 72K, 72C and 72Y are recording heads (inkjet heads) of the inkjet system of the full line type that have a length corresponding to the maximum width of the image formation region in the recording medium 24. A nozzle row is formed on the ink ejection surface of the inkjet head. The nozzle row has a plurality of nozzles arranged therein for discharging ink over the entire width of the image recording region. Each inkjet head 72M, 72K, 72C, 72Y is fixedly disposed so as to extend in the direction perpendicular to the conveyance direction (rotation direction of the image formation drum 70) of the recording medium 24.

Droplets of corresponding colored inks are ejected from the inkjet heads 72M, 72K, 72C and 72Y having the above-described configuration toward the recording surface of the recording medium 24 held on the outer circumferential surface of the image formation drum 70. As a result, the ink comes into contact with the treatment liquid that has been heretofore applied on the recording surface by the treatment liquid application unit 14, the coloring material (pigment) dispersed in the ink is aggregated, and a coloring material aggregate is formed. Therefore, the coloring material flow on the recording medium 24 is prevented and an image is formed on the recording surface of the recording medium 24. In this case, because the image formation drum 70 of the image formation unit 16 is structurally separated from the treatment liquid drum 54 of the treatment liquid application unit 14, the treatment liquid does not adhere to the inkjet heads 72M, 72K, 72C and 72Y, and the number of factors preventing the ejection of ink can be reduced.

In the present embodiment, the CMYK standard color (four colors) configuration is described, but combinations of ink colors and numbers of colors are not limited to that of the present embodiment, and if necessary, light inks, dark inks, and special color inks may be added. For example, a configuration is possible in which inkjet heads are added that eject light inks such as light cyan and light magenta. The arrangement order of color heads is also not limited.

<Drying Unit>

The drying unit 18 dries water included in the solvent separated by the coloring material aggregation action. As shown in FIG. 1, the drying unit includes a drying drum 76 and a solvent dryer 78.

The drying drum 76 is a drum that holds the recording medium 24 on the outer circumferential surface thereof and rotationally conveys the recording medium 24. The rotation of the drying drum 76 is driven and controlled by the below-described motor driver 176 (see FIG. 8). Further, the drying drum 76 is provided on the outer circumferential surface thereof with a hook-shaped holding device (device identical to the gripper 102 shown in FIG. 2). The leading end of the recording medium 24 is held by the holding device. In a state in which the leading end of the recording medium 24 is held by the holding device, the drying drum 76 is rotated to rotationally convey the recording medium. In this case, the recording medium 24 is conveyed in a state where the recording surface thereof faces outward. The drying treatment is carried out by the solvent dryer 78 with respect to the recording surface of the recording medium 24. The drying drum 76 may be provided with suction apertures on the outer circumferential surface thereof and connected to a suction device that performs suction from the suction apertures. As a result, the recording medium 24 can be held in a state of tight adherence to the outer circumferential surface of the drying drum 76.

The solvent dryer 78 is disposed in a position facing the outer circumferential surface of the drying drum 76, and includes first to fourth halogen heaters 80A to 80D, and first to third warm-air blow-out nozzles 82A to 82C, each of which is arranged between adjacent two of the halogen heaters 80A to 80D. More specifically, the first halogen heater 80A, the first warm-air blow-out nozzle 82A, the second halogen heater 80B, the second warm-air blow-out nozzle 82B, the third halogen heater 80C, the third warm-air blow-out nozzle 82C and the fourth halogen heater 80D are arranged in positions opposite the outer circumferential surface of the drying drum 76 in this order from the upstream side in the rotation direction (counterclockwise direction in FIG. 1) of the drying drum 76.

Each of the warm-air blow-out nozzles 82A to 82C is controlled to blow warm air at a prescribed temperature (for example, 50° C. to 70° C.) at a constant blowing rate (for example, 12 $m^3$/min) toward the recording medium 24. Each of the first to fourth halogen heaters 80A to 80D is controlled to a prescribed temperature (for example, 180° C.).

With the solvent dryer 78 of the above-described configuration, water included in the ink solvent on the recording surface of the recording medium 24 held by the drying drum 76 is evaporated, and drying treatment is performed. In this case, because the drying drum 76 of the drying unit 18 is structurally separated from the image formation drum 70 of the image formation unit 16, the number of ink non-ejection events caused by drying of the head meniscus portion by thermal drying can be reduced in the inkjet heads 72M, 72K, 72C and 72Y. Further, there is a degree of freedom in setting the temperature of the drying unit 18, and the optimum drying temperature can be set.

The outer circumferential surface of the aforementioned drying drum 76 may be controlled to a prescribed temperature (for example, not higher than 60° C.).

<Fixing Unit>

The fixing unit 20 includes a fixing drum 84, a halogen heater 86, a fixing roller 88, and an inline sensor 90. The halogen heater 86, the fixing roller 88, and the inline sensor 90 are arranged in positions opposite the outer circumferential surface of the fixing drum 84 in this order from the upstream side in the rotation direction (counterclockwise direction in FIG. 1) of the fixing drum 84.

The fixing drum 84 a drum that holds the recording medium 24 on the outer circumferential surface thereof and rotationally conveys the recording medium 24. The rotation of the fixing drum 84 is driven and controlled by the below-described motor driver 176 (see FIG. 8). The fixing drum 84 has a hook-shaped holding device (device identical to the gripper 102 shown in FIG. 2), and the leading end of the recording medium 24 can be held by this holding device. The recording medium 24 is rotationally conveyed by rotating the fixing drum 84 in a state in which the leading end of the recording medium 24 is held by the holding device. In this case, the recording medium 24 is conveyed in a state where the recording surface thereof faces outward, and the preheating by the halogen heater 86, the fixing treatment by the fixing roller 88 and the inspection by the inline sensor 90 are performed with respect to the recording surface. The fixing drum 84 may be provided with suction apertures on the outer circumferential surface thereof and connected to a suction device that performs suction from the suction apertures. As a result, the recording medium 24 can be held in a state of tight adherence to the outer circumferential surface of the fixing drum 84.

The halogen heater 86 is controlled to a prescribed temperature (for example, 180° C.), by which the preheating is performed with respect to the recording medium 24.

The fixing roller 88 is a roller member which applies pressure and heat to the dried ink to melt and fix the self-dispersible polymer particles in the ink so as to transform the ink into the film. More specifically, the fixing roller 88 is arranged so as to be pressed against the fixing drum 84, and a nip roller is configured between the fixing roller 88 and the fixing drum 84. As a result, the recording medium 24 is squeezed between the fixing roller 88 and the fixing drum 84, nipped under a prescribed nip pressure (for example, 1 MPa), and subjected to fixing treatment.

Further, the fixing roller 88 is configured by a heating roller in which a halogen lamp is incorporated in a metal pipe, for example made from aluminum, having good thermal conductivity and the rollers are controlled to a prescribed temperature (for example 60° C. to 80° C.). Where the recording medium 24 is heated with the heating roller, thermal energy not lower than a Tg temperature (glass transition temperature) of a latex included in the ink is applied and latex particles are melted. As a result, fixing is performed by penetration into the projections-recessions of the recording medium 24, the projections-recessions of the image surface are leveled out, and gloss is obtained.

In the above-described embodiment, heating and pressure application are used in combination, but only one of them may be performed. Further, depending on the thickness of image layer and Tg characteristic of latex particles, the fixing roller 88 may have a configuration provided with a plurality of steps. Furthermore, the surface of the fixing drum 84 may be controlled to a prescribed temperature (for example 60° C.).

On the other hand, the inline sensor 90 is a measuring device which measures the check pattern, moisture amount, surface temperature, gloss, and the like of the image fixed to the recording medium 24. A CCD sensor or the like can be used for the inline sensor 90.

With the fixing unit 20 of the above-described configuration, the latex particles located within a thin image layer formed in the drying unit 18 are melted by application of pressure and heat by the fixing roller 88. Thus, the latex particles can be reliably fixed to the recording medium 24. In addition, with the fixing unit 20, the fixing drum 84 is structurally separated from other drums. Therefore, the temperature of the fixing unit 20 can be freely set separately from the image formation unit 16 and the drying unit 18.

<Discharge Unit>

As shown in FIG. 1, the discharge unit 22 is provided after the fixing unit 20. The discharge unit 22 includes a discharge tray 92, and a transfer body 94, a conveying belt 96, and a tension roller 98 are provided between the discharge tray 92 and the fixing drum 84 of the fixing unit 20 so as to face the discharge tray 92 and the fixing drum 84. The recording medium 24 is fed by the transfer body 94 onto the conveying belt 96 and discharged onto the discharge tray 92.

<Intermediate Conveyance Unit>

The structure of the first intermediate conveyance unit 26 will be described below. The second intermediate conveyance unit 28 and the third intermediate conveyance unit 30 are configured identically to the first intermediate conveyance unit 26 and the explanation thereof will be omitted.

The first intermediate conveyance unit 26 mainly includes an intermediate conveyance body 32 and a conveyance guide 34. The conveying guide 34 has a circular-arc guide surface of the curvature along the outer circumferential surface of the intermediate conveyance body 32, and is disposed to oppose the outer circumferential surface of the intermediate conveyance body 30 at a prescribed distance.

The intermediate conveyance body 32 is a drum for receiving the recording medium 24 from a drum of a previous stage, rotationally conveying the recording medium 24, and transferring it to a drum of the subsequent stage, and is mounted to be capable of rotating freely. The intermediate conveyance body 32 is rotated by a motor (not shown in the drawings), and the rotation thereof is driven and controlled by the below-described motor driver 176 (see FIG. 8). Further, the intermediate conveyance body 32 is provided on the outer circumferential surface thereof with a hook-shaped holding device (device identical to the gripper 102 shown in FIG. 2). The leading end of the recording medium 24 is held by the holding device. In a state in which the leading end of the recording medium 24 is held by the holding device, the intermediate conveyance body 32 is rotated to rotationally convey the recording medium 24. In this case, the recording medium 24 is conveyed in a state where the recording surface thereof faces inward, whereas the non-recording surface thereof faces outward.

A plurality of blower ports are arranged in a prescribed pattern on the outer circumferential surface of the intermediate conveyance body 32. A drying unit 38 is arranged inside the intermediate conveyance body 32, and the drying unit 38 includes a halogen heater and a warm-air blow-out nozzle. Thus, warm air is blown outward from the blower ports on the outer circumferential surface of the intermediate conveyance body 32, and the recording medium 24 is supported in a floating state, and a drying treatment of the recording surface is performed. As a result, the recording surface of the recording medium 24 is prevented from coming into contact with the intermediate conveyance body 30 and adhesion of the treatment liquid to the intermediate conveyance body 32 can be avoided. The recording medium 24 that is supported in a floating state by the intermediate conveyance body 30 is conveyed in a state where the non-recording surface thereof is guided along the guide surface.

With the first intermediate conveyance unit 26 of the above-described configuration, when the recording medium 24 is conveyed by the intermediate conveyance body 30, the conveyance can be performed in a contactless state of the recording surface. Therefore, image defects caused by the contact of the recording surface can be avoided. Further, warm air is blown from the intermediate conveyance body 30, so that the recording surface can be dried while the recording medium 24 is being conveyed.

The recording medium 24 conveyed by the first intermediate conveyance unit 26 is transferred to a drum of the subsequent stage (that is, the image formation drum 70). In this case, the transfer of the recording medium 24 is performed by synchronizing the holding device of the intermediate conveyance unit 26 and the holding device (the gripper 102) of the image formation unit 16. The transferred recording medium 24 is held by the image formation drum 70 and rotationally conveyed.

<Structure of Ink Heads>

Next, the structure of the inkjet heads is described. The heads 72M, 72K, 72C and 72Y for the respective colored inks have the same structure, and a reference numeral 150 is hereinafter designated to any of the inkjet heads (hereinafter also referred to simply as the heads).

Figure 6A:
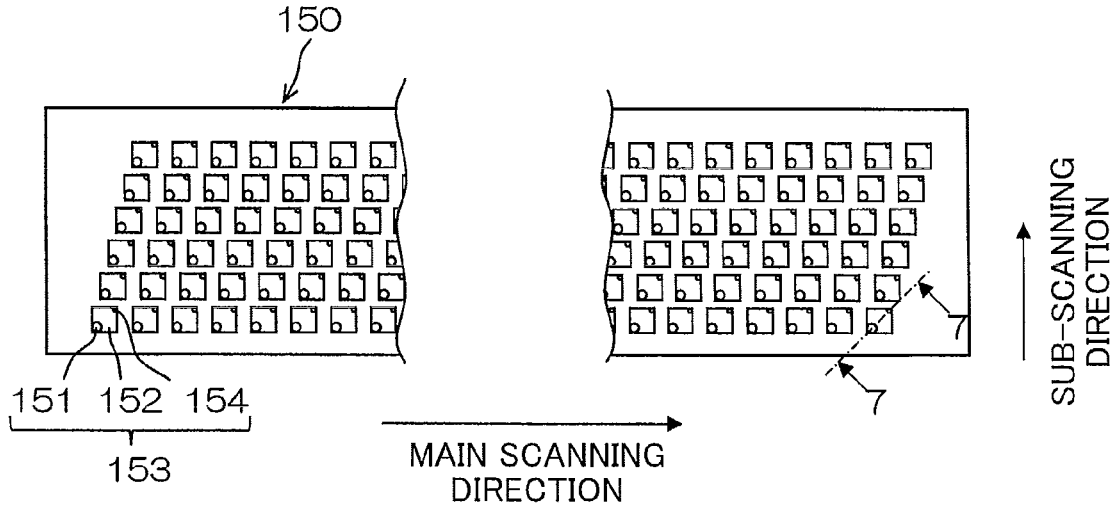
FIGS. 6A to 6C are plan view perspective diagrams showing examples of the composition of an inkjet head.
Figure 6B:
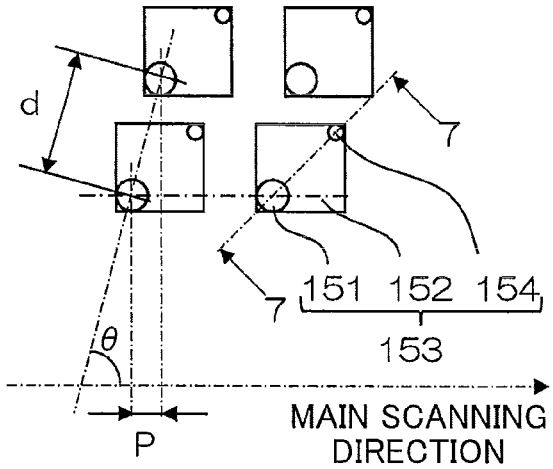
Figure 6C:
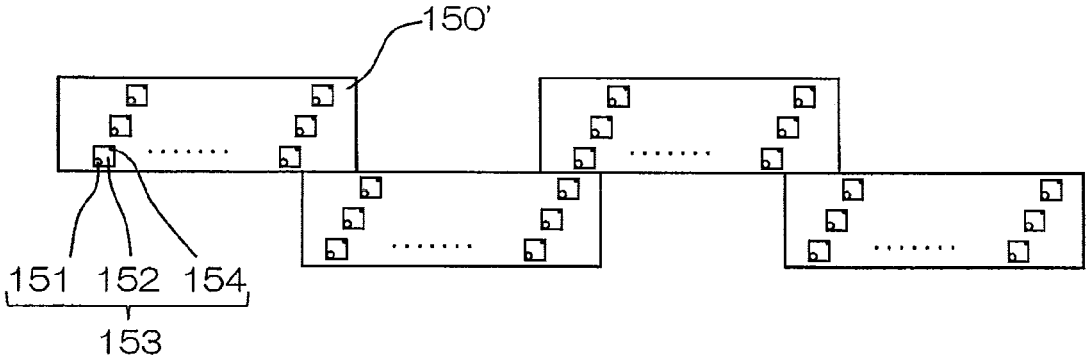
Figure 7:
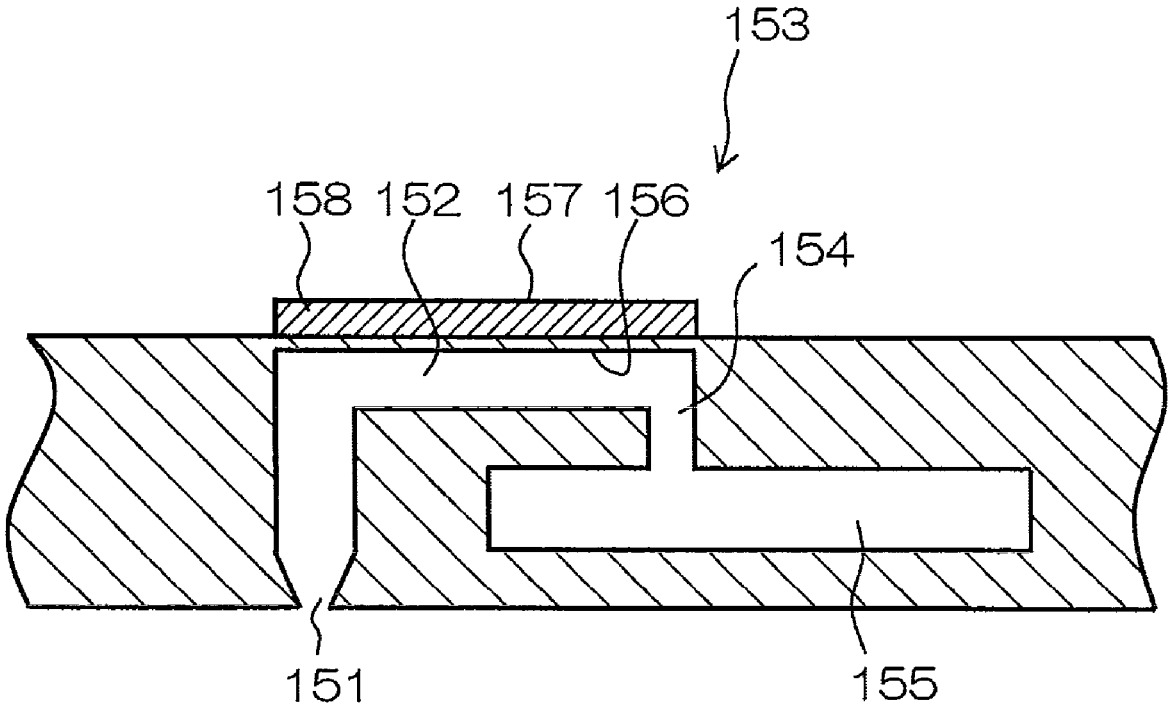
FIG. 7 is a cross-sectional view along line 7-7 in FIGS. 6A and 6B, showing the internal composition of an ink chamber unit.

FIG. 6A is a perspective plan view showing an embodiment of the configuration of the head 150, FIG. 6B is an enlarged view of a portion thereof, and FIG. 6C is a perspective plan view showing another example of the configuration of the head 150. FIG. 7 is a cross-sectional view taken along the line 7-7 in FIGS. 6A and 6B, showing the inner structure of an ink chamber unit in the head 50.

The nozzle pitch in the head 150 should be minimized in order to maximize the density of the dots printed on the surface of the recording medium 24. As shown in FIGS. 6A and 6B, the head 150 according to the present embodiment has a structure in which a plurality of ink chamber units (i.e., droplet ejection units serving as recording units) 153, each having a nozzle 151 forming an ink ejection aperture, a pressure chamber 152 corresponding to the nozzle 151, and the like, are disposed two-dimensionally in the form of a staggered matrix, and hence the effective nozzle interval (the projected nozzle pitch) as projected in the lengthwise direction of the head 150 (the main scanning direction: the direction perpendicular to the conveyance direction of the recording medium 24) is reduced and high nozzle density is achieved.

The mode of forming one or more nozzle rows through a length corresponding to the entire width of the recording medium 24 in the main scanning direction substantially perpendicular to the conveyance direction of the recording medium 24 (the sub-scanning direction) is not limited to the embodiment described above. For example, instead of the configuration in FIG. 6A, as shown in FIG. 6C, a line head having nozzle rows of a length corresponding to the entire width of the recording medium 24 can be formed by arranging and combining, in a staggered matrix, short head blocks 150' having a plurality of nozzles 151 arrayed in a two-dimensional fashion. Furthermore, although not shown in the drawings, it is also possible to compose a line head by arranging short heads in one row.

The planar shape of the pressure chamber 152 provided for each nozzle 151 is substantially a square, and the nozzle 151 and an ink supply port 154 are disposed in both corners on a diagonal line of the square. The shape of the pressure chamber 152 is not limited to that of the present embodiment, and a variety of planar shapes, for example, a polygon such as a rectangle (rhomb, rectangle, etc.), a pentagon and a heptagon, a circle, and an ellipse can be employed.

Each pressure chamber 152 is connected to a common channel 155 through the supply port 154. The common channel 155 is connected to an ink tank (not shown), which is a base tank for supplying ink, and the ink supplied from the ink tank is delivered through the common flow channel 155 to the pressure chambers 152.

A piezoelectric element 158 provided with an individual electrode 157 is bonded to a diaphragm 156, which forms a face (the upper face in FIG. 7) of the pressure chamber 152 and also serves as a common electrode. When a drive voltage is applied to the individual electrode 157, the piezoelectric element 158 is deformed, the volume of the pressure chamber 152 is thereby changed, and the ink is ejected from the nozzle 151 by the variation in pressure that follows the variation in volume. When the piezoelectric element 158 returns to the original state after the ink has been ejected, the pressure chamber 152 is refilled with new ink from the common channel 155 through the supply port 154.

The present embodiment applies the piezoelectric elements 158 as ejection power generation devices to eject the ink from the nozzles 151 arranged in the head 150; however, instead, a thermal system that has heaters within the pressure chambers 152 to eject the ink using the pressure resulting from film boiling by the heat of the heaters can be applied.

As shown in FIG. 6B, the high-density nozzle head according to the present embodiment is achieved by arranging the plurality of ink chamber units 153 having the above-described structure in a lattice fashion based on a fixed arrangement pattern, in a row direction which coincides with the main scanning direction, and a column direction which is inclined at a fixed angle of $\theta$ with respect to the main scanning direction, rather than being perpendicular to the main scanning direction.

More specifically, by adopting a structure in which the ink chamber units 153 are arranged at a uniform pitch d in line with a direction forming the angle of $\theta$ with respect to the main scanning direction, the pitch P of the nozzles projected so as to align in the main scanning direction is $d \times \cos\theta$, and hence the nozzles 151 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the embodiments shown in the drawings, and it is also possible to apply various other types of nozzle arrangements, such as an arrangement structure having one nozzle row in the sub-scanning direction.

Furthermore, the scope of application of the present invention is not limited to a printing system based on the line type of head, and it is also possible to adopt a serial system where a short head that is shorter than the breadthways dimension of the recording medium 24 is moved in the breadthways direction (main scanning direction) of the recording medium 24, thereby performing printing in the breadthways direction, and when one printing action in the breadthways direction has been completed, the recording medium 24 is moved through a prescribed amount in the sub-scanning direction perpendicular to the breadthways direction, printing in the breadthways direction of the recording medium 24 is carried out in the next printing region, and by repeating this sequence, printing is performed over the whole surface of the printing region of the recording medium 24.

<Description of Control System>

Figure 8:
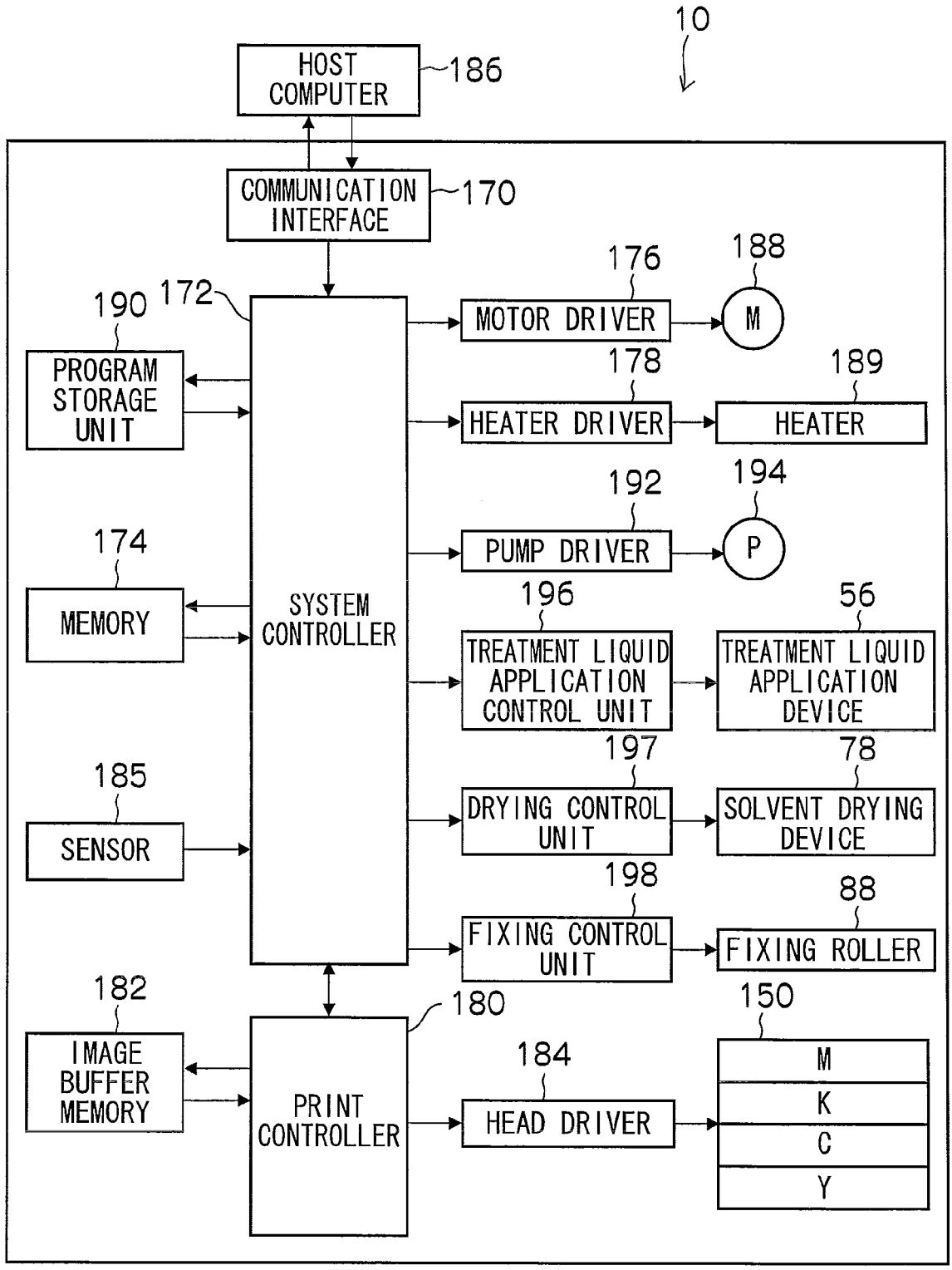
FIG. 8 is a principal block diagram illustrating the system configuration of the inkjet recording apparatus in FIG. 1.

FIG. 8 is a block diagram of the main portion of a system configuration of the inkjet recording apparatus 10. The inkjet recording apparatus 10 includes a communication interface 170, a system controller 172, a memory 174, the motor driver 176, a heater driver 178, a printing control unit 180, an image buffer memory 182, a head driver 184, a sensor 185, a program storage unit 190, a pump driver 192, a treatment liquid application control unit 196, a drying control unit 197, and a fixing control unit 198.

The communication interface 170 is an interface unit that receives image data sent from a host computer 186. A serial interface such as USB (Universal Serial Bus), IEEE 1394, Ethernet, and a wireless network, or a parallel interface such as Centronix can be applied as the communication interface 170. A buffer memory (not shown) may be installed in the part of the interface to increase the communication speed. The image data sent from the host computer 186 are introduced into the inkjet recording apparatus 10 through the communication interface 170 and temporarily stored in the memory 174.

The memory 174 is a storage device that temporarily stores the images inputted through the communication interface 170 and reads/writes the data via the system controller 172. The memory 174 is not limited to a memory composed of semiconductor elements and may use a magnetic medium such as a hard disk.

The system controller 172 includes a central processing unit (CPU) and a peripheral circuitry thereof, functions as a control device that controls the entire inkjet recording apparatus 10 according to a predetermined program, and also functions as an operational unit that performs various computations. Thus, the system controller 172 controls various units such as the communication interface 170, the memory 174, the motor driver 176, the heater driver 178, the pump driver 192, the treatment liquid application control unit 196, the drying control unit 197 and the fixing control unit 198, performs communication control with the host computer 180, performs read/write control of the memory 174, and also generates control signals for controlling the various units.

Programs that are executed by the CPU of the system controller 172 and various data necessary for performing the control are stored in the memory 174. The memory 174 may be a read-only storage device or may be a writable storage device such as EEPROM. The memory 174 can be also used as a region for temporary storing image data, a program expansion region, and a computational operation region of the CPU.

Various control programs are stored in the program storage unit 190, and a control program is read out and executed in accordance with commands from the system controller 172. The program storage unit 190 may use a semiconductor memory, such as a ROM, EEPROM, or a magnetic disk, or the like. The program storage unit 190 may be provided with an external interface, and a memory card or PC card may also be used. Naturally, a plurality of these storage media may also be provided. The program storage unit 190 may also be combined with a storage device for storing operational parameters, and the like (not shown).

The motor driver 176 drives a motor 188 in accordance with commands from the system controller 172. In FIG. 8, the plurality of motors disposed in the respective sections of the inkjet recording apparatus 10 are represented by the reference numeral 188. For example, the motor 188 shown in FIG. 8 includes the motors that drive the paper transfer drum 52, the treatment liquid drum 54, the image formation drum 70, the drying drum 76, the fixing drum 84 and the transfer body 94 shown in FIG. 1, the motors that drive the intermediate conveyance bodies 32 in the first, second and third intermediate conveyance units 26, 28 and 30, and the motor that constitutes the roller movement mechanism for advancing and retracting the paper pressing roller 74 shown in FIG. 1 following the radial direction of the image formation drum 70.

The heater driver 178 is a driver that drives the heater 189 in accordance with commands from the system controller 172. In FIG. 8, the plurality of heaters disposed in the inkjet recording apparatus 10 are represented by the reference numeral 189. For example, the heater 189 shown in FIG. 8 includes the halogen heaters 80A to 80D in the solvent dryer 78 arranged in the drying unit 18 shown in FIG. 1, and the halogen heaters in the drying units 38 arranged in the intermediate conveyance bodies 32.

The pump driver 192 is a driver that drives the pump 194 in accordance with commands from the system controller 172. In FIG. 8, the plurality of pumps disposed in the inkjet recording apparatus 10 are represented by the reference numeral 194. For example, the pump 194 shown in FIG. 8 includes the pump connected to the suction apertures of the suction unit 112 in the image formation drum 70 shown in FIG. 2.

The treatment liquid application control unit 196, the drying control unit 197 and the fixing control unit 198 control the operations of the treatment liquid application device 56, the solvent dryer 78 and the fixing roller 88, respectively, in accordance with commands from the system controller 172.

The printing control unit 180 has a signal processing function for performing a variety of processing and correction operations for generating signals for print control from the image data within the memory 174 according to control of the system controller 172, and supplies the generated printing data (dot data) to the head driver 184. The required signal processing is implemented in the printing control unit 180, and the ejection amount and ejection timing of droplets in the heads 150 are controlled through the head driver 184 based on the image data. As a result, the desired dot size and dot arrangement are realized.

The printing control unit 180 is provided with the image buffer memory 182, and data such as image data or parameters are temporarily stored in the image buffer memory 182 during image data processing in the printing control unit 180. A mode is also possible in which the printing control unit 180 and the system controller 172 are integrated and configured by one processor.

The head driver 184 generates drive signals for driving the piezoelectric elements 158 of the heads 150, on the basis of the dot data supplied from the print controller 180, and drives the piezoelectric elements 158 by applying the generated drive signals to the piezoelectric elements 158. A feedback control system for maintaining constant drive conditions in the recording heads 150 may be included in the head driver 184 shown in FIG. 8.

The sensor 185 represents the sensors disposed in the respective sections of the inkjet recording apparatus 10. For example, the sensor 185 includes the inline sensor 90 shown in FIG. 1, temperature sensors, position determination sensors, and pressure sensors. The output signals of the sensor 185 are sent to the system controller 172, and the system controller 172 controls the respective sections of the inkjet recording apparatus 10 by sending the command signals to the respective sections in accordance with the output signals of the sensor 185.

According to the inkjet recording apparatus 10 in the present embodiment, the image formation drum 70 of the image formation unit 16 is composed in such a manner that, by mutual engagement in the front/rear direction of the front supporting body 100 including the grippers 102, which grip the leading end portion of the recording medium 24, and the rear supporting body 110 including the suction units 112, which hold the trailing end portion of the recording medium 24 by suction, the paper supporting surface 122 constituted of the outer circumferential surfaces of the front and rear supporting bodies 100 and 110 between the grippers 102 and the suction units 112 can be extended and contracted in accordance with the length of the recording medium 24. Furthermore, it is possible to hold the trailing end portion of the recording medium 24 by suction by applying a negative pressure (vacuum pressure) through the suction holes provided in the suction units 112, and therefore it is possible to prevent interference with the paper pressing roller 74, even if the paper pressing roller 74 is situated adjacently in the position opposing the outer circumferential surface of the image formation drum 70. It is thus possible to hold and secure thick strong paper in a state of tight adherence to the outer circumferential surface of the image formation drum 70, without the paper floating up above the drum. Consequently, it is possible to record an image with high quality by means of the inkjet heads 72M, 72K, 72C and 72Y.

Moreover, since the paper pressing roller 74 is disposed so as to maintain the uniform gap from the outer circumferential surface of the image formation drum 70, then it is possible to hold and secure the recording medium 24 in a state of tight adherence to the outer circumferential surface of the image formation drum 70, without creating projections-recessions in the recording medium 24. Further, by altering the gap between the paper pressing roller 74 and the outer circumferential surface of the image formation drum 70 in accordance with the thickness of the recording medium 24, then even if using recording media 24 of different thicknesses, it is possible to hold and secure the recording medium 24 in a state of tight adherence to the outer circumferential surface of the image formation drum 70, without creating projections-recessions in the recording medium 24.

Furthermore, by making it possible to control selectively the on/off switching of suction by the respective suctioning devices 112 arranged along the axial direction of the image formation drum 70, in accordance with the width of the recording medium 24, then it is possible to alter the suction range in accordance with the width of the recording medium 24, and consequently the suction force applied on the recording medium 24 can be increased, while preventing wasteful suction. It is thus possible to hold and secure thicker paper on the outer circumferential surface of the image formation drum 70. Furthermore, it is also possible to control the timing of the on/off switching of suction by the suction units 112 in accordance with the trailing end position of the recording medium 24. In this case, it is possible to raise the suction force when securing the trailing end portion of the recording medium 24, and thicker paper can be held and secured on the outer circumferential surface of the image formation drum 70. The on/off switching of suction by the respective suction units 112 is controlled by the system controller 172 shown in FIG. 8.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

an image formation drum which is rotatable in a prescribed rotational direction and includes a front supporting body and a rear supporting body, outer circumferential surfaces of the front and rear supporting bodies constituting a medium supporting surface on which a recording medium is held, the front supporting body having a leading end holding device capable of holding a leading end portion of the recording medium by gripping, the rear supporting body having a trailing end holding device capable of holding a trailing end portion of the recording medium by suction, the front and rear supporting bodies mutually engaging in a circumferential direction of the image formation drum in a state where a length of the medium supporting surface in the circumferential direction is adjustable in accordance with a length of the recording medium in the circumferential direction;

an ink ejection device which is disposed at a position opposing an outer circumferential surface of the image formation drum, and which ejects droplets of ink toward the recording medium rotationally conveyed by the image formation drum; and a guide member which is disposed on an upstream side of the ink ejection device in terms of the rotational direction of the image formation drum, and which causes the trailing end portion of the recording medium, the leading end portion of which is gripped by the leading end holding device, to tightly adhere to the outer circumferential surface of the image formation drum.

2. The inkjet recording apparatus as defined in claim 1, wherein the guide member is arranged separately from the outer circumferential surface of the image formation drum.

3. The inkjet recording apparatus as defined in claim 1, wherein the guide member includes a roller member which is rotatable in a prescribed direction.

4. The inkjet recording apparatus as defined in claim 3, further comprising a roller movement device which moves the roller member along a radial direction of the image formation drum in accordance with a thickness of the recording medium.

5. The inkjet recording apparatus as defined in claim 1, wherein:

the rear supporting body includes a plurality of suction devices arranged in an axial direction of the image formation drum; and the inkjet recording apparatus further comprises a first control device which selectively controls on/off switching of suction by the respective suction devices in accordance with a width of the recording medium.

6. The inkjet recording apparatus as defined in claim 5, further comprising a second control device which controls a timing of on/off switching of suction by the respective suction devices in accordance with a position of the trailing end portion of the recording medium.

* * * * *